US009994026B2

(12) United States Patent
Miyano et al.

(10) Patent No.: US 9,994,026 B2
(45) Date of Patent: Jun. 12, 2018

(54) LINE INKJET HEAD CLEANING APPARATUS, CLEANING METHOD, AND CLEANING PROGRAM

(71) Applicant: TECHNOLOGY RESEARCH ASSOCIATION FOR FUTURE ADDITIVE MANUFACTURING, Tokyo (JP)

(72) Inventors: Hideaki Miyano, Kanagawa (JP); Yoshikazu Ooba, Kanagawa (JP); Yousuke Katou, Kanagawa (JP); Koukichi Suzuki, Kanagawa (JP); Yuya Daicho, Kanagawa (JP)

(73) Assignee: TECHNOLOGY RESEARCH ASSOCIATION FOR FUTURE ADDITIVE MANUFACTURING, Tokyo (JP)

( * ) Notice: Subject to any disclaimer, the term of this patent is extended or adjusted under 35 U.S.C. 154(b) by 0 days. days.

(21) Appl. No.: 15/119,542

(22) PCT Filed: Sep. 9, 2015

(86) PCT No.: PCT/JP2015/075654

§ 371 (c)(1),
(2) Date: Aug. 17, 2016

(87) PCT Pub. No.: WO2017/042922

PCT Pub. Date: Mar. 16, 2017

(65) Prior Publication Data

US 2017/0259576 A1 Sep. 14, 2017

(51) Int. Cl.
*B41J 2/165* (2006.01)

(52) U.S. Cl.
CPC ..... *B41J 2/16552* (2013.01); *B41J 2/16535* (2013.01)

(58) Field of Classification Search
None
See application file for complete search history.

(56) References Cited

U.S. PATENT DOCUMENTS 6,257,697 B1 7/2001 Kurata
2004/0200258 A1* 10/2004 Hess ..... B66F 7/0658 72/457

(Continued)

FOREIGN PATENT DOCUMENTS

JP 7-246710 A 9/1995
JP 2005-169791 A 6/2006

(Continued)

OTHER PUBLICATIONS

International Search Report (ISR) dated Oct. 27, 2015 for International Application No. PCT/JP2015/075654.

(Continued)

*Primary Examiner* — Alejandro Valencia
(74) *Attorney, Agent, or Firm* — Ladas & Parry LLP

(57) ABSTRACT

A line inkjet head cleaning apparatus for effectively cleaning a long line inkjet head includes a wiper fixer extending in a longitudinal direction of a line inkjet head as a cleaning target and having a predetermined width in a vertical direction, a cleaning wiper being fixed to an upper end thereof, a cleaning solution tank having a predetermined volume accommodating the wiper fixer and having an opening in an upper surface, and a driver that vertically moves the wiper fixer between a cleaning solution in the cleaning solution tank and the line inkjet head as a cleaning target positioned above the opening.

9 Claims, 14 Drawing Sheets

(56) References Cited

U.S. PATENT DOCUMENTS

| | | | | |
|---|---|---|---|---|
| 2007/0002094 | A1* | 1/2007 | Kim | B41J 2/16535 347/33 |
| 2009/0179954 | A1 | 7/2009 | Silverbrook et al. | |
| 2009/0303279 | A1 | 12/2009 | Roh | |

FOREIGN PATENT DOCUMENTS

| | | | |
|---|---|---|---|
| JP | 2006-305772 | A | 11/2006 |
| JP | 2009-12368 | A | 1/2009 |
| WO | 2011/067301 | A1 | 6/2011 |

OTHER PUBLICATIONS

Written Opinion (WO) dated Oct. 27, 2015 for International Application No. PCT/JP2015/075654.
J-PlatPat English abstract of JP 2006-305772 A.
J-PlatPat English abstract of JP 2009-12368 A.
J-PlatPat English abstract of JP 7-246710 A.
J-PlatPat English abstract of JP 2005-169791 A.
Supplementary European Search Report (SESR) dated Mar. 9, 2018 for Application No. EP 15 89 7899.

* cited by examiner

LINE INKJET HEAD CLEANING APPARATUS, CLEANING METHOD, AND CLEANING PROGRAM

RELATED APPLICATION

This application is an application under 35 U.S.C. 371 of International Application No. PCT/JP2015/075654 filed on Sep. 9, 2015, the entire contents of which are incorporated herein by reference.

TECHNICAL FIELD

The present invention relates to a line inkjet head cleaning apparatus, cleaning method, and cleaning program.

BACKGROUND ART

In the abovementioned technical field, patent literature 1 describes a method of periodically cleaning an inkjet head around which a powder is sticking. Also, patent literature 1 discloses a technique which, when washing a wiper for cleaning an inkjet head with alcohol, switches a state in which the wiper is rotated and dipped in alcohol, and a state in which the wiper is abutted against the inkjet head.

CITATION LIST

Patent Literature

Patent literature 1: WO2011-067301

SUMMARY OF THE INVENTION

Technical Problem

Unfortunately, when the technique described in the aforementioned literature is applied to a long line inkjet head, the rotating shaft of the wiper becomes too long, and this causes a slack.

The present invention enables to provide a technique of solving the above-described problem.

Solution to Problem

One aspect of the present invention provides a line inkjet head cleaning apparatus including a wiper fixer extending in a longitudinal direction of a line inkjet head as a cleaning target and having a predetermined width in a vertical direction, a cleaning wiper being fixed to an upper end thereof, a cleaning solution tank having a predetermined volume accommodating the wiper fixer and having an opening in an upper surface, and a driver that vertically moves the wiper fixer between a cleaning solution in the cleaning solution tank and the line inkjet head as a cleaning target positioned above the opening.

Another aspect of the present invention provides a line inkjet head cleaning method for a line inkjet head cleaning apparatus including a wiper fixer extending in a longitudinal direction of a line inkjet head as a cleaning target and having a predetermined width in a vertical direction, a cleaning wiper being fixed to an upper end thereof, and a cleaning solution tank having a predetermined volume accommodating the wiper fixer and having an opening in an upper surface, including vertically moving the wiper fixer between a cleaning solution in the cleaning solution tank and the line inkjet head as a cleaning target positioned above the opening.

Still other aspect of the present invention provides a line inkjet head cleaning program for a line inkjet head cleaning apparatus including a wiper fixer extending in a longitudinal direction of a line inkjet head as a cleaning target and having a predetermined width in a vertical direction, a cleaning wiper being fixed to an upper end thereof, and a cleaning solution tank having a predetermined volume accommodating the wiper fixer and having an opening in an upper surface, the program causing a computer to execute a method, including vertically moving the wiper fixer between a cleaning solution in the cleaning solution tank and the line inkjet head as a cleaning target positioned above the opening.

Advantageous Effect of Invention

The present invention can effectively clean a long line inkjet head.

DESCRIPTION OF THE EMBODIMENTS

Preferred embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

A line inkjet head cleaning apparatus 100 according to the first embodiment of the present invention will be explained with reference to FIG. 1.

Figure 1:
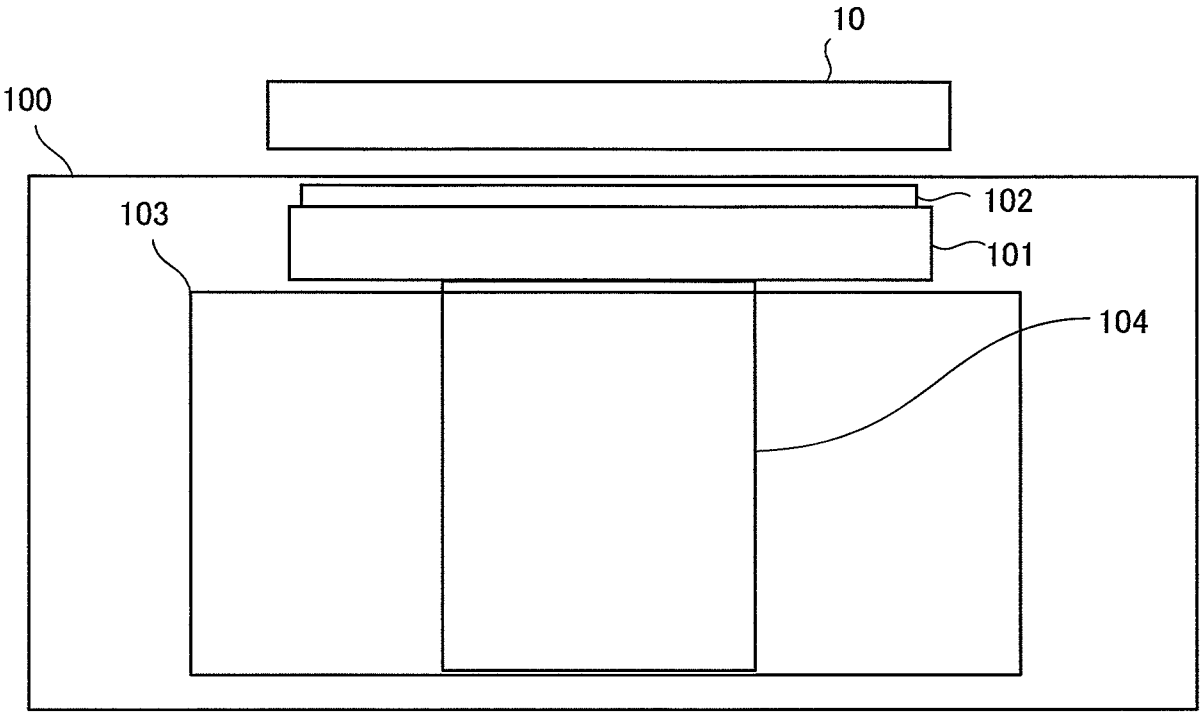
FIG. 1 is view showing the arrangement of a line inkjet head cleaning apparatus according to the first embodiment of the present invention.

As shown in FIG. 1, the line inkjet head cleaning apparatus 100 includes a wiper fixer 101, cleaning solution tank 103, and driver 104.

The wiper fixer 101 extends in the longitudinal direction of a line inkjet head 10 as a cleaning target, and has a predetermined width in the vertical direction. A cleaning wiper 102 is fixed to the upper end of the wiper fixer 101

The cleaning solution tank 103 has a predetermined volume accommodating the wiper fixer 101, and has an opening in an open upper surface.

The driver 104 vertically moves the wiper fixer 101 between a cleaning solution in the cleaning solution tank 103 and the line inkjet head 10 positioned above the opening of the cleaning solution tank 103.

When cleaning the line inkjet head 10, a cleaning solution is supplied into the cleaning solution tank 103.

In the abovementioned arrangement, the wiper fixer 101 is dipped together with the wiper 102 in the cleaning solution before cleaning the line inkjet head 10. When cleaning the line inkjet head 10 from this state, the driver 104 moves the wiper fixer 101 upward, and stops the movement of the wiper fixer 101 in a state in which the distal end of the wiper 102 is in contact with the line inkjet head 10. Since the cleaning solution is sticking to the wiper 102, the line inkjet head 10 is cleaned with the cleaning solution.

Also, if the wiper 102 is dirtied by dust, ink, powder (e.g., sand), or the like when cleaning the line inkjet head 10, the wiper 102 can be dipped in the cleaning solution. That is, the driver 104 moves the wiper fixer 101 downward and dips the wiper fixer 101 and wiper 102 in the cleaning solution, thereby removing the dirtiness sticking to the wiper by the cleaning solution.

After that, the driver 104 moves up the wiper fixer 101 again, and stops the movement of the wiper fixer 101 in the state in which the distal end of the wiper 102 is in contact with the line inkjet head 10. Since the cleaning solution is sticking to the wiper 102, the line inkjet head 10 is cleaned by the cleaning solution.

By moving the wiper fixer 101 upward and downward by the driver 104 as described above, the state in which the wiper 102 is dipped in the cleaning solution and the state in which the distal end of the wiper 102 is in contact with the line inkjet head 10 are switched. Accordingly, this line inkjet head cleaning apparatus can be used as a cleaning apparatus for a long line inkjet head 10 without causing any slack in the wiper fixer 101.

Second Embodiment

Figure 2:
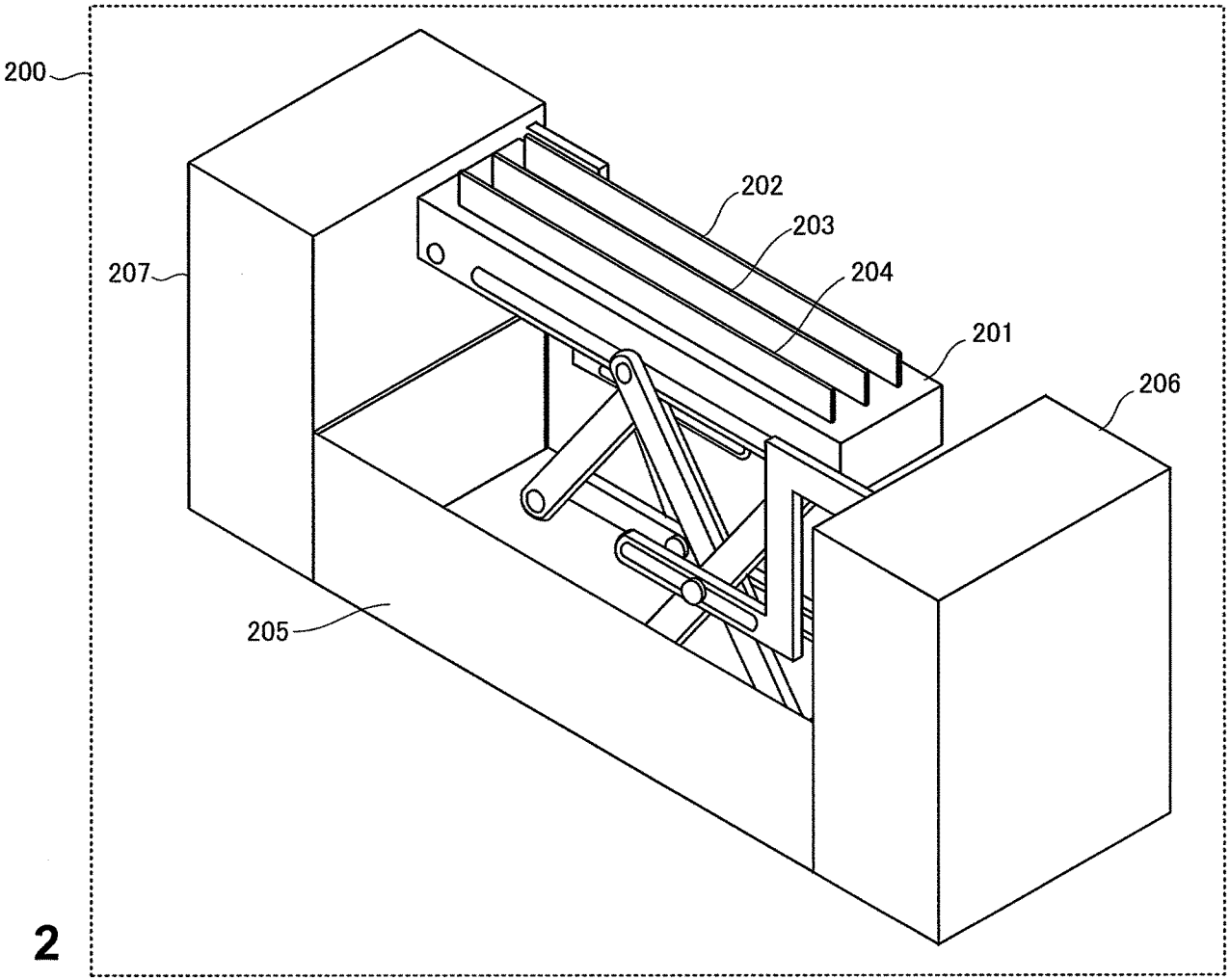
FIG. 2 is a view showing the arrangement of a line inkjet head cleaning apparatus according to the second embodiment of the present invention.

A line inkjet head cleaning apparatus according to the second embodiment of the present invention will be explained below with reference to FIG. 2. FIG. 2 is a view for explaining the overall arrangement of the line inkjet head cleaning apparatus according to this embodiment.

As shown in FIG. 2, a line inkjet head cleaning apparatus 200 includes a rectangular-parallelepiped wiper fixer 201 having a predetermined length, a cleaning solution tank 205, and drivers 206 and 207.

The wiper fixer 201 includes three wipers 202, 203, and 204 embedded in the upper surface of the wiper fixer 201 so as to extend in the longitudinal direction. The length of the wiper fixer 201 of this embodiment is set to, e.g., 1 m. Also, the wipers 202 to 204 are formed by, e.g., silicone rubber.

Figure 3:
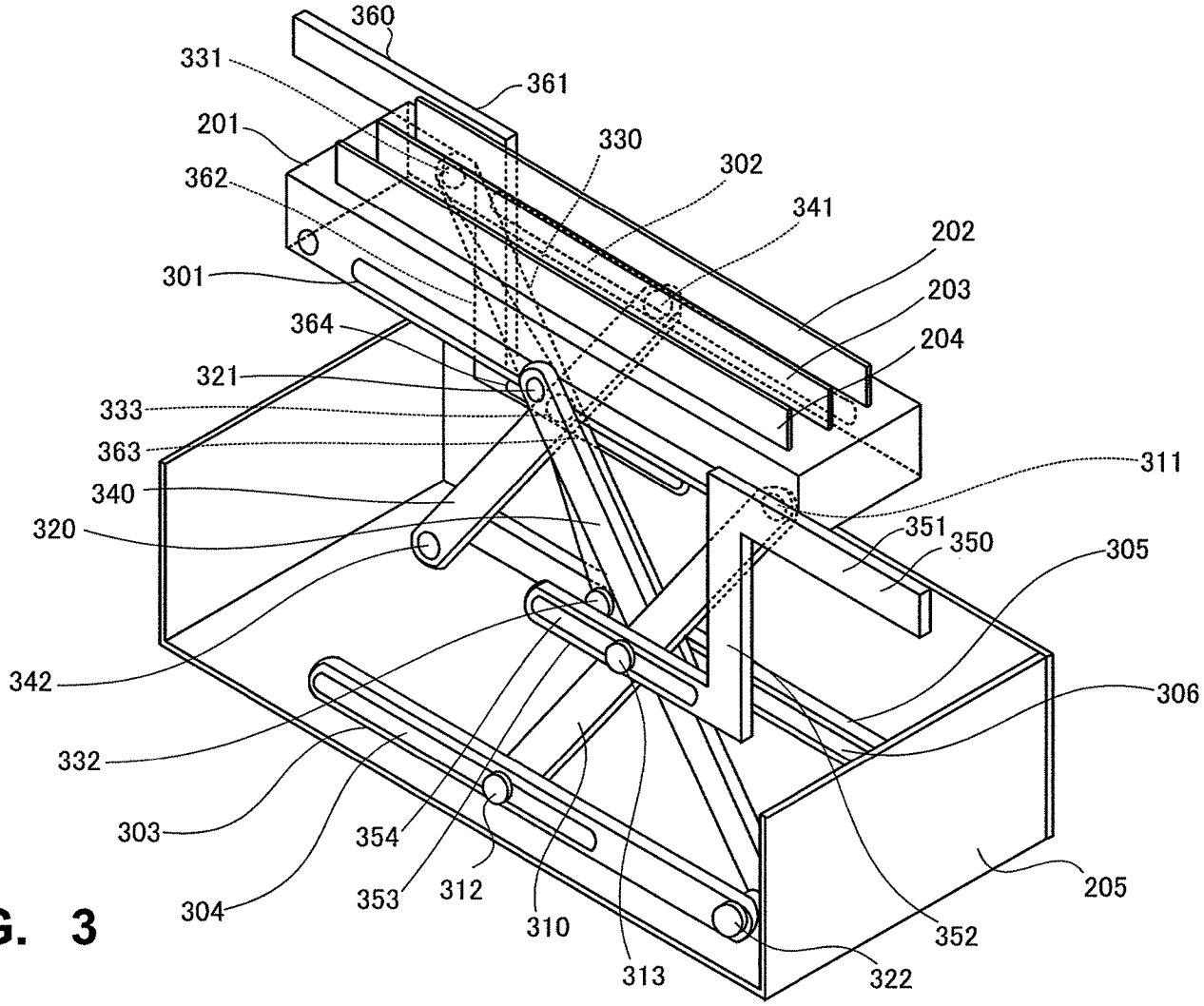
FIG. 3 is a view for explaining the arrangement of main parts of the line inkjet head cleaning apparatus according to the second embodiment of the present invention.

The cleaning solution tank 205 has a rectangular parallelepiped shape having a predetermined depth and an opening in an open upper surface. When performing cleaning, a cleaning solution is supplied into the cleaning solution tank 205. Also, a lifting mechanism shown in FIG. 3 is installed inside the cleaning solution tank 205.

Next, the abovementioned lifting mechanism will be explained with reference to FIG. 3.

The lifting mechanism is a mechanism for vertically moving the wiper fixer 201, and includes support members 310, 320, 330, and 340 and groove members 303 and 305. All the support members 310, 320, 330, and 340 have a plate-like shape having the same length. The groove members 303 and 305 are fixed on the bottom surface of the cleaning solution tank 205.

Also, a sliding groove 301 is formed in one side surface of the wiper fixer 201 in a direction in which the wipers 202 to 204 extend. In addition, a sliding groove 302 is formed in the other side surface of the wiper fixer 201 in the direction in which the wipers 202 to 204 extend.

One end portion of the support member 310 is pivotally locked by a locking member 311 to one end portion in the longitudinal direction of one side surface of the wiper fixer 201 in which the sliding groove 301 is formed. The other end portion of the support member 310 is slidably locked by the locking member 312 in a sliding groove 304 formed in the groove member 303.

A central portion of the support member 320 in the longitudinal direction is pivotally locked by a locking member 313 to a central portion of the support member 310 in the longitudinal direction. Furthermore, one end portion of the support member 320 is slidably locked in the sliding groove 301 by a locking member 321, and the other end portion of the support member 320 is pivotally locked to one end portion of the groove member 303 by a locking member 322.

One end portion of the support member 330 is pivotally locked by a locking member 331 to the other end portion in the longitudinal direction of the other side surface of the wiper fixer 201 in which the sliding groove 302 is formed. The other end portion of the support member 330 is slidably locked by a locking member 332 in a sliding groove 306 formed in the groove member 305.

A central portion of the support member 340 in the longitudinal direction is pivotally locked by a locking member 333 to a central portion of the support member 330 in the longitudinal direction. In addition, one end portion of the support member 340 is slidably locked in the sliding groove 302 by a locking member 341, and the other end portion of the support member 340 is pivotally locked to the other end portion of the groove member 305 by a locking member 342.

The locking member 313 in the central portion of the support member 310 is slidably locked along a horizontal groove 354 formed in a lower horizontal portion 353 of a lifting member 350. One end of the lower horizontal portion 353 of the lifting member 350 is connected to the lower end of a vertical portion 352, and the upper end of the vertical portion 352 is connected to the other end of an upper horizontal portion 351.

The locking member 333 in the central portion of the support member 330 is slidably locked along a horizontal groove 364 formed in a lower horizontal portion 363 of a lifting member 360. The other end of the lower horizontal portion 363 of the lifting member 360 is connected to the lower end of a vertical portion 362, and the upper end of the vertical portion 362 is connected to one end of an upper horizontal portion 361.

Figure 4:
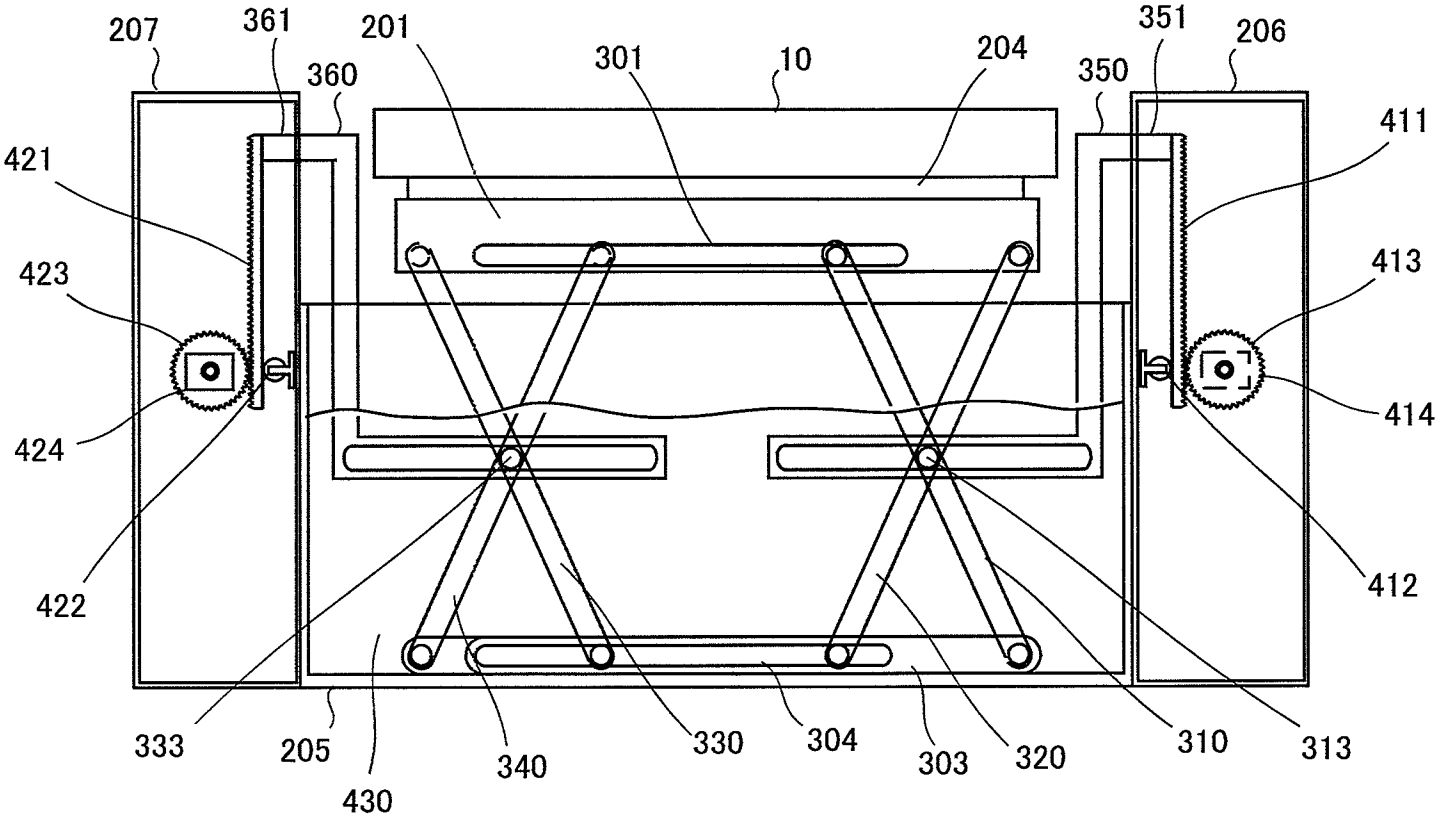
FIG. 4 is a view for explaining the arrangement of a driver of the line inkjet head cleaning apparatus according to the second embodiment of the present invention.

An example of a driver for vertically driving the lifting mechanism will now be explained with reference to FIG. 4. Referring to FIG. 4, the same portions as those of the aforementioned arrangement are denoted by the same reference numerals, and a detailed explanation thereof will be omitted.

FIG. 4 shows a state in which the lift rear portion moves up the wiper fixer 201 and the wiper 204 abuts against the bottom surface of a line inkjet head 10, i.e., inkjet nozzles. As shown in FIG. 4, the driver 206 for vertically moving the lifting member 350 is installed outside one end portion of the cleaning solution tank 205, and the driver 207 for vertically moving the lifting member 360 is installed outside the other end portion of the cleaning solution tank 205.

The upper end of a linear gear 411 vertically extending downward is connected to one end of the upper horizontal portion 351 of the lifting member 350. The teeth of the linear gear 411 are meshed with a gear 413 attached to the rotating shaft of a motor 414, and a roller 412 supports the linear gear 411 so that the mesh does not loosen.

The upper end of a linear gear 421 vertically extending downward is connected to the other end of the upper horizontal portion 361 of the lifting member 360. The teeth of the linear gear 421 are meshed with a gear 423 attached to the rotating shaft of a motor 424, and a roller 422 supports the linear gear 421 so that the mesh does not loosen.

Figure 5:
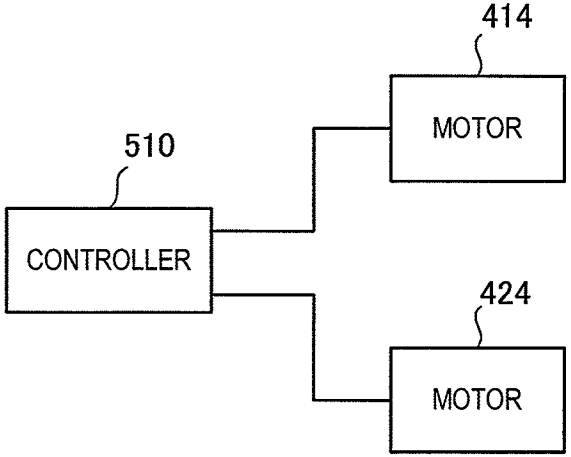
FIG. 5 is a view for explaining the configuration of driving control of the line inkjet head cleaning apparatus according to the second embodiment of the present invention.

Also, as shown in FIG. 5, the motors 414 and 412 of the drivers 206 and 207 operate in synchronism with each other under the control of a controller 510 which is a computer apparatus.

Figure 6:
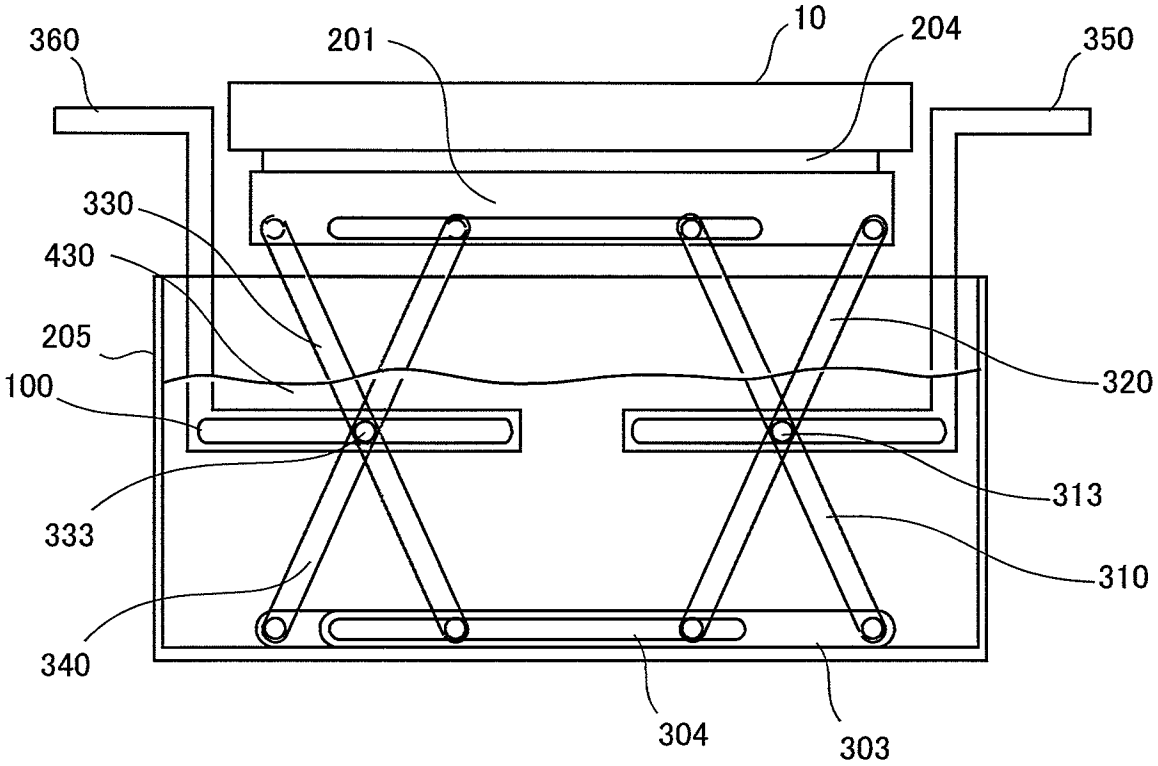
FIG. 6 is a view for explaining a state in which a wiper fixing member rises in the line inkjet head cleaning apparatus according to the second embodiment of the present invention.
Figure 7:
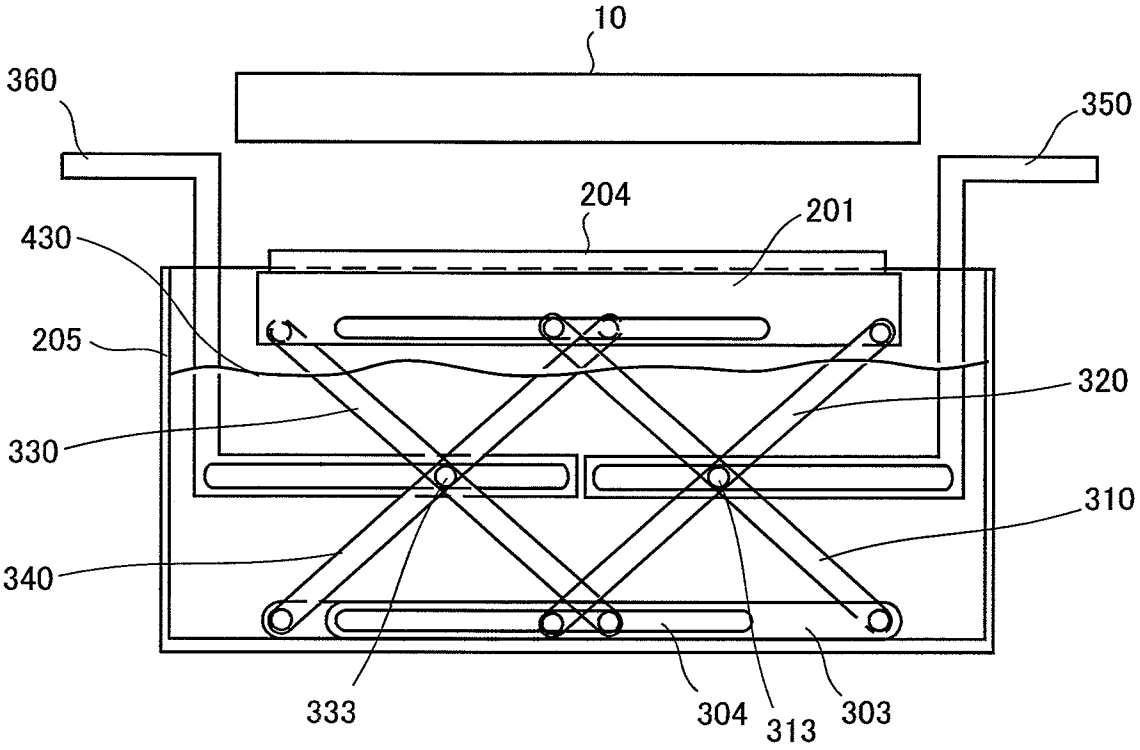
FIG. 7 is a view for explaining a state in which the wiper fixing member moves in the line inkjet head cleaning apparatus according to the second embodiment of the present invention.
Figure 8:
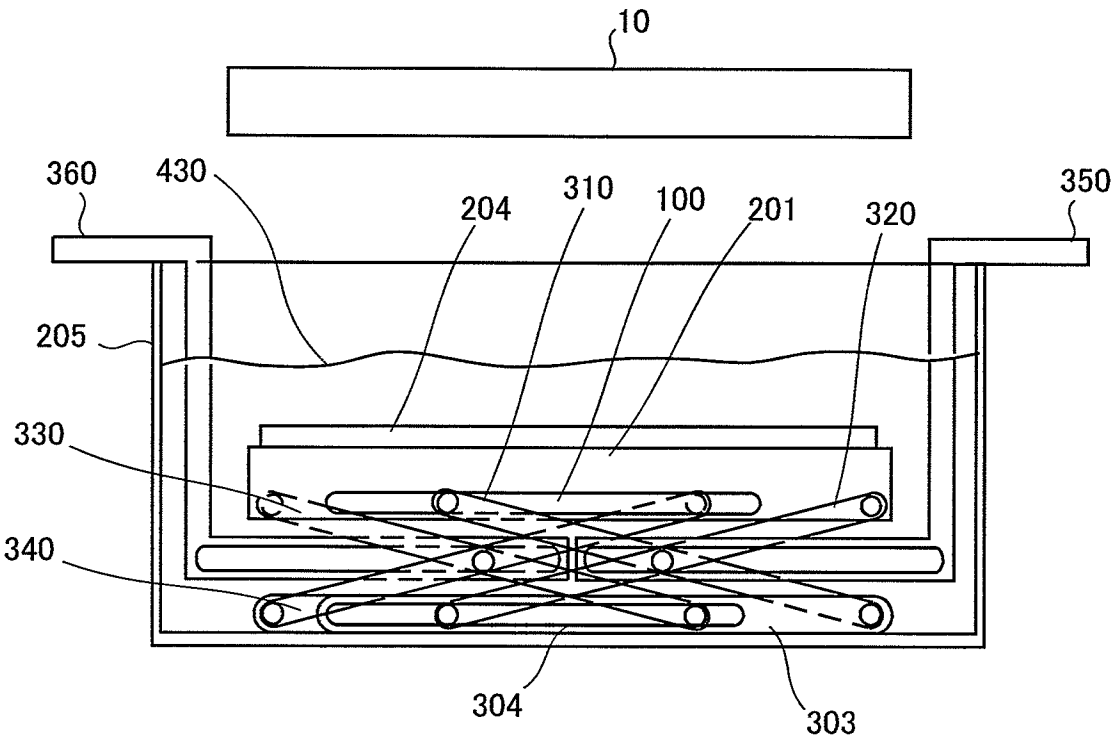
FIG. 8 is a view for explaining a state in which the wiper fixing member falls in the line inkjet head cleaning apparatus according to the second embodiment of the present invention.

When the lifting members 350 and 360 are moved to information in the abovementioned arrangement, the wiper 204 abuts against the bottom portion of the line inkjet head 10 as shown in FIG. 6. When the lifting members 350 and 360 are slightly moved down, the wiper 204 separates from the line inkjet head 10 as shown in FIG. 7. When the lifting members 350 and 360 are further moved down, the wiper 204 is dipped in a cleaning solution 430 in the cleaning solution tank 205, as shown in FIG. 8.

Figure 9:
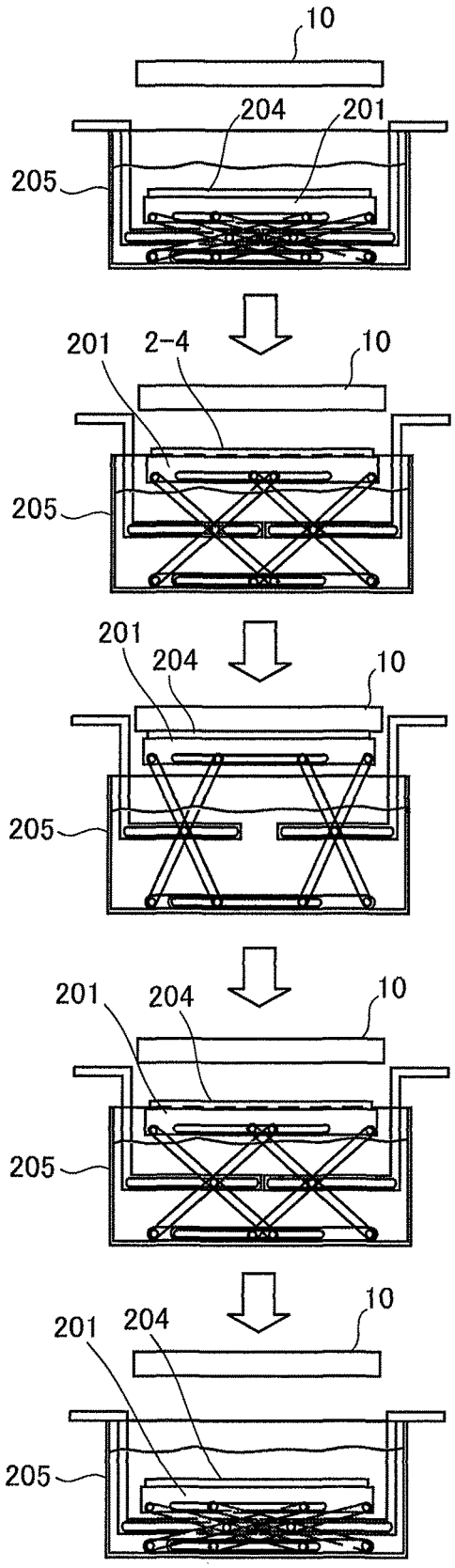
FIG. 9 is a view for explaining the rise and fall of a wiper in the line inkjet head cleaning apparatus according to the second embodiment of the present invention.

Accordingly, when the abovementioned state is repeated several times by a sequence shown in FIG. 9, dirtiness sticking to the nozzles of the line inkjet head 10 is removed by the wiper 204, and the wiper 204 is cleaned by the cleaning solution 430.

In the above embodiment, the drivers 206 and 207 vertically move the wiper fixer 201, thereby switching the state in which the wipers 202 to 204 are dipped in the cleaning solution 430, and the state in which the distal ends of the wipers 202 to 204 are in contact with the line inkjet head 10. Therefore, this line inkjet head cleaning apparatus can be used as a cleaning apparatus for a long line inkjet head 10 without causing any slack in the wiper fixer 201. In addition, since the wiper fixer 201 need not be rotated, the cleaning solution tank 205 having only a lifting space can be used. Accordingly, the volume of the cleaning solution tank 205 can be made smaller than that when rotating the wiper. This makes it possible to downsize a line inkjet printer including the line inkjet head cleaning apparatus 200 of this embodiment.

Third Embodiment

Figure 10:
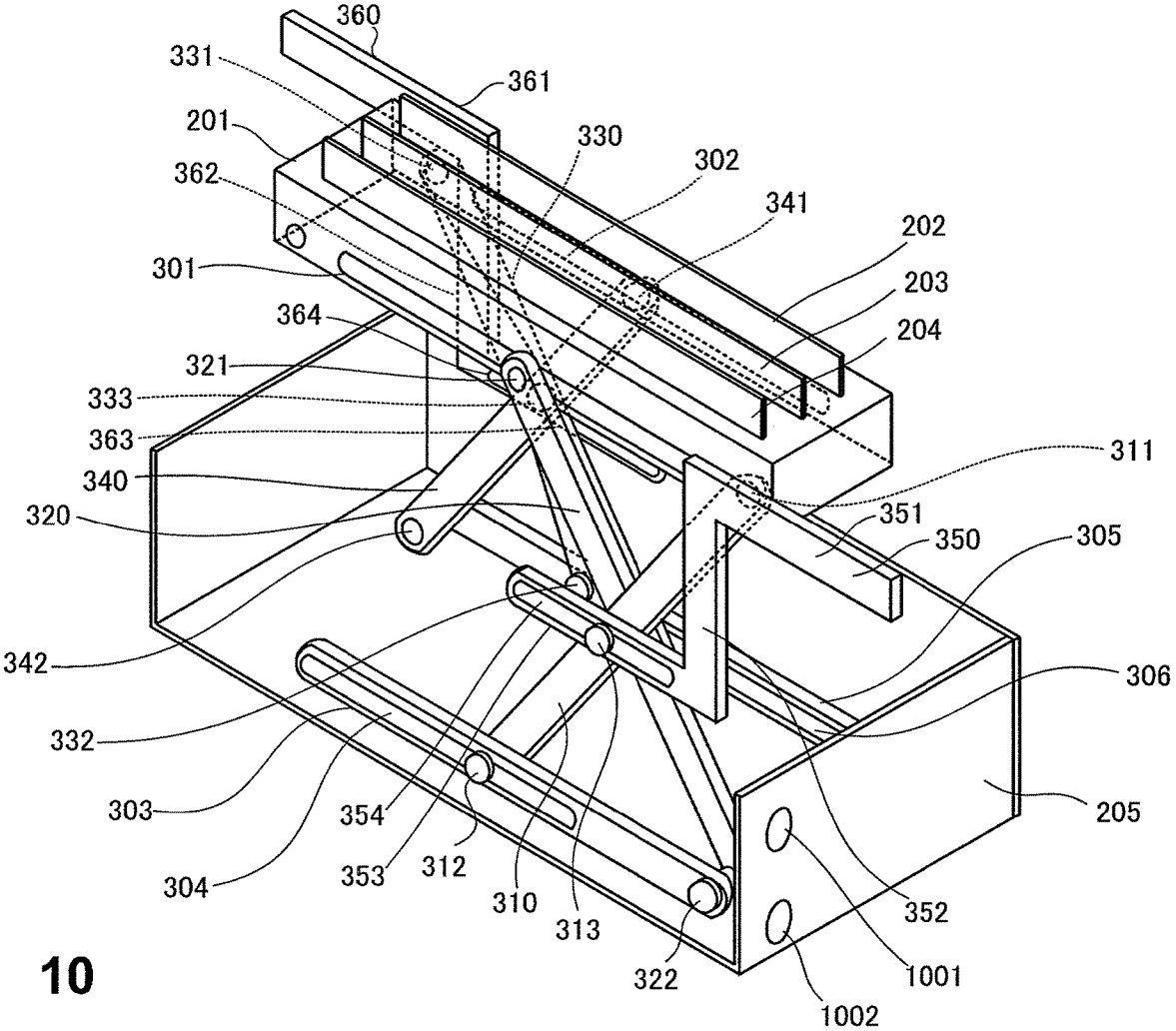
FIG. 10 is a view for explaining the arrangement of main parts of a line inkjet head cleaning apparatus according to the third embodiment of the present invention.
Figure 11:
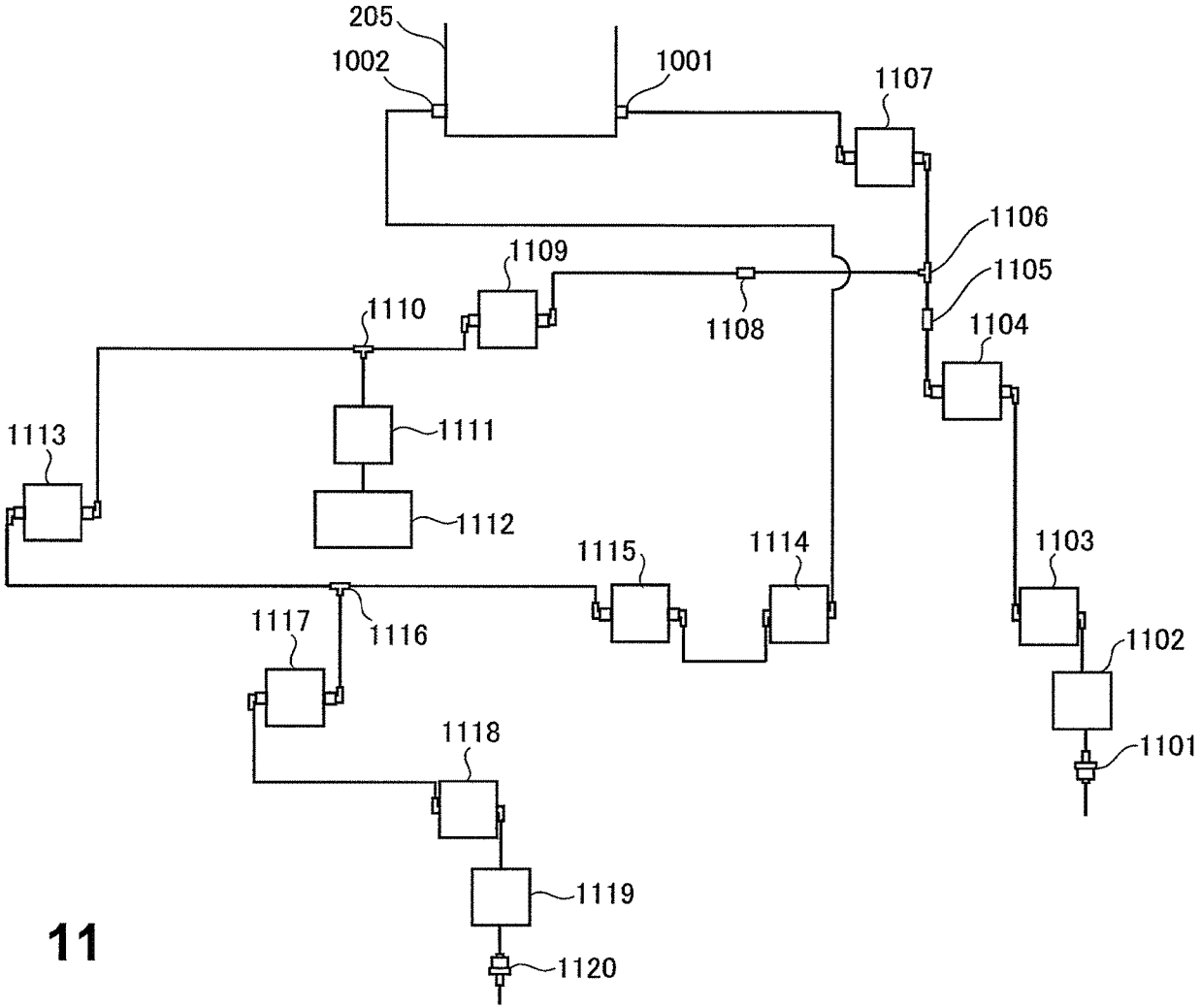
FIG. 11 is a view for explaining a cleaning solution circulating circuit of the line inkjet head cleaning apparatus according to the third embodiment of the present invention.

A line inkjet head cleaning apparatus according to the third embodiment of the present invention will be explained below with reference to FIG. 10. FIG. 10 is a view for explaining the arrangement of main parts of a line inkjet head cleaning apparatus 1000 according to this embodiment. The line inkjet head cleaning apparatus 1000 according to this embodiment differs from the abovementioned second embodiment in that a cleaning solution tank 205 has a supply port 1001 and discharge port 1002. The rest of the arrangement and the operations are the same as those of the second embodiment, so the same reference numerals as in the second embodiment denote the same components and the same operations, and a detailed explanation thereof will be omitted.

When performing cleaning, a pump 1103 inhales a cleaning solution through an inhale port 1101 and filter 1102. Then, the inhaled cleaning solution is supplied from the supply port 1001 to the cleaning solution tank 205 through a valve 1104, check valve 1105, T joint 1106, and pump 1107.

When cleaning is finished, the cleaning solution in the cleaning solution tank 205 is discharged from the discharge port 1002, and stored in a cleaning solution storage tank 1112 through a filter 1114, pump 1115, T joint 1116, valve 1113, T joint 1110, and pump 1111.

When performing cleaning by using the cleaning solution stored in the cleaning solution storage tank 1112, the cleaning solution in the cleaning solution storage tank 1112 is supplied to the cleaning solution tank 205. That is, the cleaning solution in the cleaning solution storage tank 1112 is supplied from the supply port 1001 to the cleaning solution tank 205 through the pump 1111, the T joint 1110, a valve 1109, a check valve 1108, the T joint 1106, and the pump 1107.

When disposing the dirty cleaning solution in the cleaning solution tank 205, the cleaning solution in the cleaning solution tank 205 is discharged from the discharge port 1002, and discharged from a discharge port 1120 through the filter 1114, the pump 1115, the T joint 1116, a valve 1117, a filter 1118, and a pump 1119.

When disposing the dirty cleaning solution in the cleaning solution storage tank 1112, the cleaning solution in the cleaning solution storage tank 1112 is discharged from the discharge port 1120 through the pump 1111, valve 1113, T joint 1116, valve 1117, filter 1118, and pump 1119.

In the aforementioned arrangement, a cleaning solution made of, e.g., highly volatile alcohol or glycol ether can be stored in the cleaning solution storage tank 1112 when performing no cleaning, so the safety increases.

Fourth Embodiment

Figure 12:
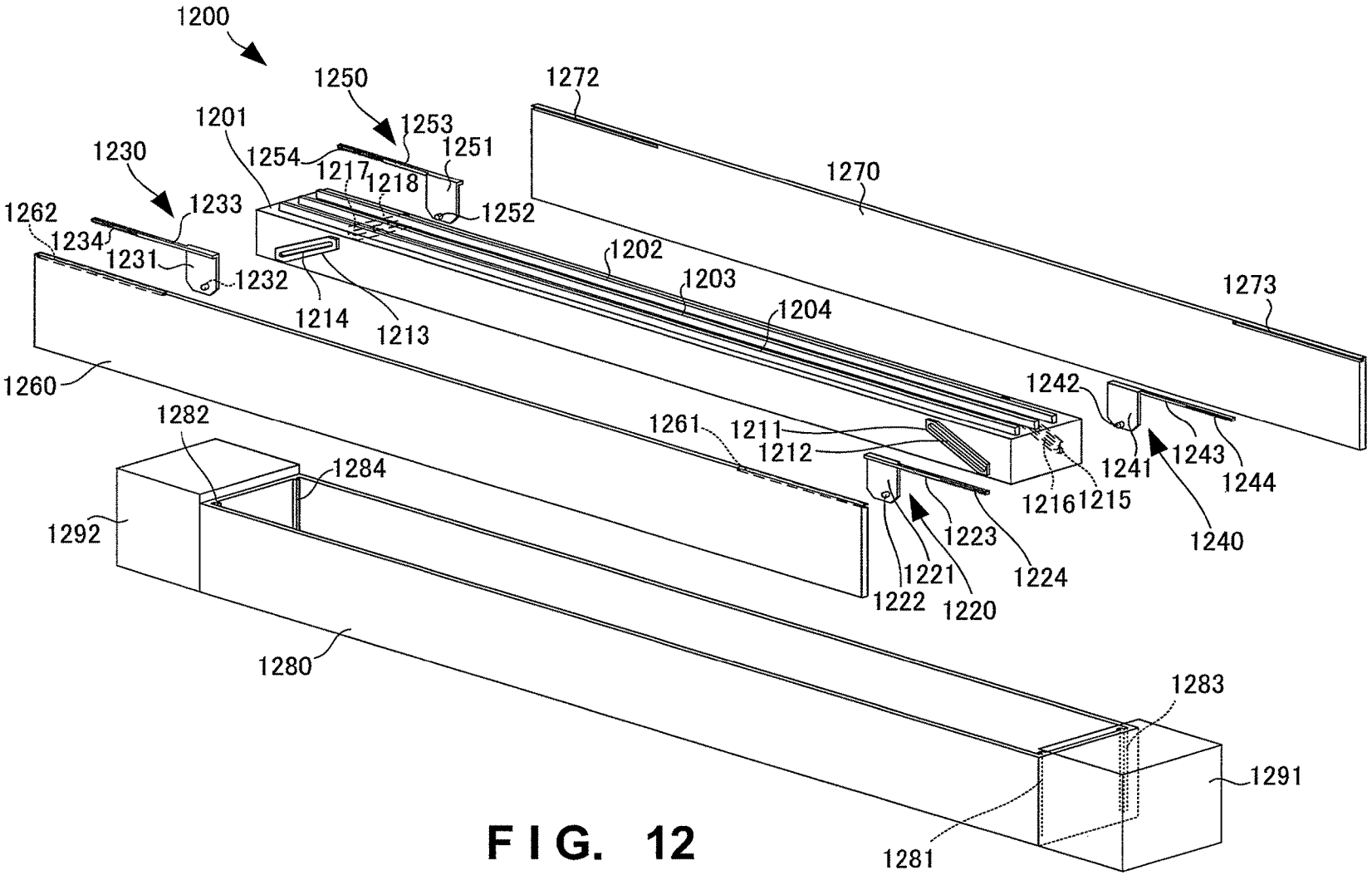
FIG. 12 is an exploded perspective view showing the arrangement of a line inkjet head cleaning apparatus according to the fourth embodiment of the present invention.

A line inkjet head cleaning apparatus according to the fourth embodiment of the present invention will be explained below with reference to FIGS. 12 to 14. FIG. 12 is an exploded perspective view of main parts for explaining the arrangement of the line inkjet head cleaning apparatus according to this embodiment.

As shown in FIG. 12, a line inkjet head cleaning apparatus 1200 of this embodiment includes a wiper fixer 1201, sliding members 1220, 1230, 1240, and 1250, support members 1260 and 1270, cleaning solution tank 1280, and drivers 1291 and 1292.

The wiper fixer 1201 has a rectangular parallelepiped shape having a length of, e.g., about 1 m, and three wipers 1202 to 1204 extending in the longitudinal direction are fixed parallel at predetermined intervals on the upper surface.

A groove member 1211 having a groove 1212 inclining downward from the other end portion to one end portion is fixed to one end portion of one side surface of the wiper fixer 1201. A groove member 1213 having a groove 1214 inclining downward from one end portion to the other end portion is fixed to the other end portion of one side surface of the wiper fixer 1201.

A groove member 1215 having a groove 1216 inclining downward from the other end portion to one end portion is fixed to one end portion of the other side surface of the wiper fixer 1201. A groove member 1217 having a groove 1218 inclining downward from one end portion to the other end portion is fixed to the other end portion of the other side surface of the wiper fixer 1201.

The sliding member 1220 includes a sliding plate 1221, and a projection 1222 which is locked in and slides along the groove 1212 of the groove member 1211 is formed in a predetermined position of the lower portion of the other surface of the sliding plate 1221. The other end portion of a sliding rod 1223 which is locked in and slides along a groove 1261 horizontally formed in the upper portion of one end portion of the plate-like support member 1260 is fixed to the upper portion of one surface of the sliding plate 1221. A linear gear 1224 is formed on one end portion of the sliding rod 1223.

The sliding member 1230 includes a sliding plate 1231, and a projection 1232 which is locked in and slides along the groove 1214 of the groove member 1213 is formed in a predetermined position of the lower portion of the other surface of the sliding plate 1231. One end portion of a sliding rod 1233 which is locked in and slides along a groove 1262 horizontally formed in the upper portion of the other end portion of the support member 1260 is fixed to the upper portion of one surface of the sliding plate 1231. A linear gear 1234 is formed on the other end portion of the sliding rod 1233.

The sliding member 1240 includes a sliding plate 1241, and a projection 1242 which is locked in and slides along the groove 1216 of the groove member 1215 is formed in a predetermined position of the lower portion of the other surface of the sliding plate 1241. The other end portion of a sliding rod 1243 which is locked in and slides along a groove 1271 horizontally formed in the upper portion of one end portion of the plate-like support member 1270 is fixed to the upper portion of one surface of the sliding plate 1241. A linear gear 1244 is formed on one end portion of the sliding rod 1243.

The sliding member 1250 includes a sliding plate 1251, and a projection 1252 which is locked in and slides along the groove 1218 of the groove member 1217 is formed in a predetermined position of the lower portion of the other surface of the sliding plate 1251. One end portion of a sliding rod 1253 which is locked in and slides along a groove 1272 horizontally formed in the upper portion of the other end portion of the support member 1270 is fixed to the upper portion of one surface of the sliding plate 1251. A linear gear 1254 is formed on the other end portion of the sliding rod 1253.

A vertically extending groove 1281 is formed in one end portion of one inner surface of the cleaning solution tank 1280, and a vertically extending groove 1282 is formed in the other end portion. Also, a vertically extending groove 1283 is formed in one end portion of the other inner surface of the cleaning solution tank 1280, and a vertically extending groove 1284 is formed in the other end portion.

In addition, the driver 1291 is installed in one end portion of the cleaning solution tank 1280, and the driver 1292 is installed in the other end portion of the cleaning solution tank 1280.

In the aforementioned arrangement, the projections 1222, 1232, 1242, and 1252 of the sliding members 1220, 1230, 1240, and 1250 are respectively locked in the grooves 1212, 1214, 1216, and 1218 of the groove members 1211, 1213, 1215, and 1217. Furthermore, the sliding rods 1223, 1233, 1243, and 1253 of the sliding members 1220, 1230, 1240, and 1250 are respectively locked in the grooves 1261 and 1262 of the support member 1260 and the grooves 1271 and 1272 of the support member 1270. In this state, the two end portions of the support member 1260 are inserted into the grooves 1281 and 1282, and the two end portions of the support member 1270 are inserted into the grooves 1283 and 1284. Consequently, the wiper fixer 1201 is locked to be vertically movable.

Figure 13:
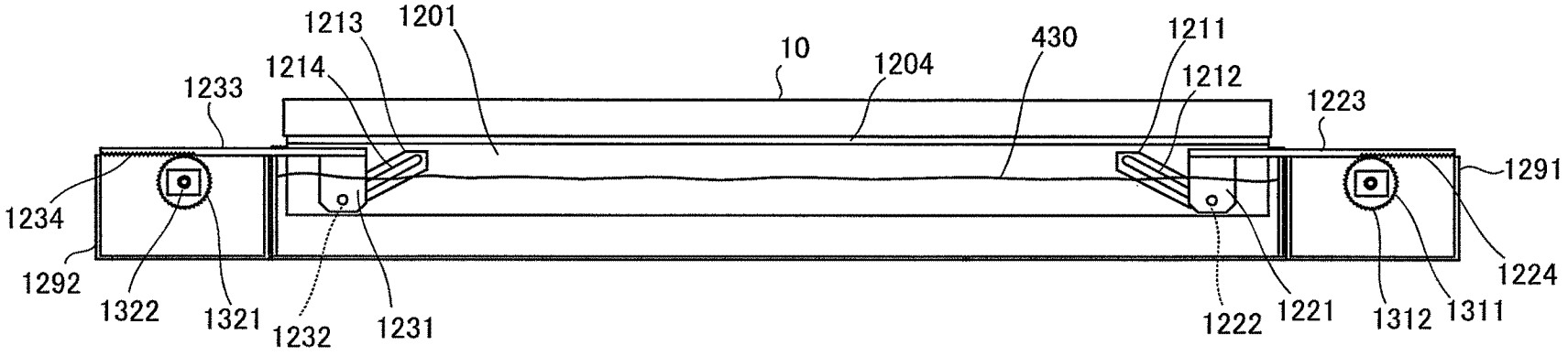
FIG. 13 is a view for explaining a state in which a wiper rises in the line inkjet head cleaning apparatus according to the fourth embodiment of the present invention.

That is, as shown in FIG. 13, the driver 1291 includes a motor 1312 having a rotating shaft to which a gear 1311 which meshes with the linear gear 1224 of the sliding rod 1223 is attached. Although not shown, the driver 1291 also includes a motor having a rotating shaft to which a gear which meshes with the linear gear 1244 of the sliding rod 1243 is attached. Likewise, the driver 1292 includes a motor 1322 having a rotating shaft to which a gear 1321 which meshes with the linear gear 1234 of the sliding rod 1233 is attached. Although not shown, the driver 1292 also includes a motor having a rotating shaft to which a gear which meshes with the linear gear 1254 of the sliding rod 1253 is attached. A controller (not shown) which is a computer apparatus drives these four motors in synchronism with each other.

FIG. 13 shows a state in which the sliding members 1220 and 1240 are moved toward one end portion of the wiper fixer'1201, and the sliding members 1230 and 1250 are moved toward the other end portion of the wiper fixer 1201. In this state, the projections 1221, 1231, 1241, and 1251 of the sliding members 1220, 1230, 1240, and 1250 are respectively positioned in the lower portions of the grooves 1212, 1214, 1216, and 1218 of the groove members 1211, 1213, 1215, and 1217, so the wiper fixer 1201 rises. Consequently, the wipers 1202 to 1204 abut against the bottom surface of the line inkjet head 10, and hence can clean the inkjet nozzles.

Figure 14:
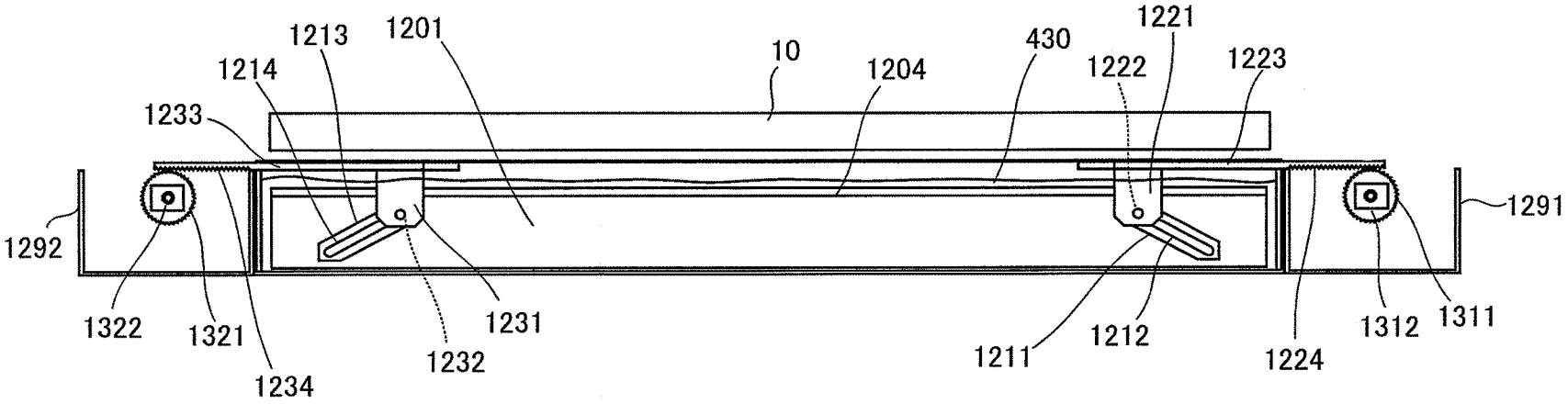
FIG. 14 is a view for explaining a state in which the wiper falls in the line inkjet head cleaning apparatus according to the fourth embodiment of the present invention.

On the other hand, FIG. 14 shows a state in which the sliding members 1220 and 1240 are moved toward the other end portion of the wiper fixer 1201, and the sliding members 1230 and 1250 are moved toward one end portion of the wiper fixer 1201. In this state, the projections 1221, 1231, 1241, and 1251 of the sliding members 1220, 1230, 1240, and 1250 are respectively positioned in the upper portions of the grooves 1212, 1214, 1216, and 1218 of the groove members 1211, 1213, 1215, and 1217, so the wiper fixer 1201 falls. Consequently, the wipers 1202 to 1204 are dipped in the cleaning solution 430 in the cleaning solution tank 1280, so the dirtiness of the wipers 1202 to 1204 can be removed by the cleaning solution.

The abovementioned embodiment can also achieve the same effect as that of the second embodiment.

Note that a circulating circuit connected to a cleaning solution storage tank for storing a cleaning solution may also be formed in the line inkjet head cleaning apparatus 1200 of the fourth embodiment in the same manner as in the third embodiment.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The present invention is applicable to a system including a plurality of devices or a single apparatus. The present invention is also applicable even when an information processing program for implementing the functions of the embodiments is supplied to the system or apparatus directly or from a remote site. Hence, the present invention also incorporates the program installed in a computer to implement the functions of the present invention by the computer, a medium storing the program, and a WWW (World Wide Web) server that causes a user to download the program. Especially, the present invention incorporates at least a non-transitory computer readable medium storing a program that causes a computer to execute processing steps included in the above-described embodiments.

The invention claimed is:

1. A line inkjet head cleaning apparatus comprising:

a wiper fixer extending in a longitudinal direction of a line inkjet head as a cleaning target and having a predetermined width in a vertical direction, a cleaning wiper being fixed to an upper end of the wiper fixer and extending in the longitudinal direction;

a cleaning solution tank having a predetermined volume accommodating said wiper fixer and having an opening in an upper surface; and a driver that vertically moves said wiper fixer between a cleaning solution in said cleaning solution tank and the line inkjet head as a cleaning target positioned above the opening to enable the cleaning wiper to contact the line inkjet head without rotating the wiper fixer or the cleaning wiper.

2. The line inkjet head cleaning apparatus according to claim 1, further comprising:

a cleaning solution storage tank;

a unit that transfers the cleaning solution in said cleaning solution tank to said cleaning solution storage tank; and a unit that transfers the cleaning solution in said cleaning solution storage tank to said cleaning solution tank.

3. The line inkjet head cleaning apparatus according to claim 1, further comprising:

a first sliding groove and a second sliding groove having a predetermined length and formed in two side surfaces extending in the longitudinal direction of said wiper fixer such that said first sliding groove and said second sliding groove extend in the longitudinal direction;

a first groove member fixed to a bottom portion of said cleaning solution tank, and having a third sliding groove parallel to said first sliding groove;

a second groove member fixed to the bottom portion of said cleaning solution tank, and having a fourth sliding groove parallel to said second sliding groove;

a first support member having a predetermined length, one end portion thereof being pivotally locked by one end in the longitudinal direction of one side surface of said wiper fixer in which said first sliding groove is formed, and the other end portion thereof being slidably locked in said third sliding groove;

a second support member having the predetermined length, a central portion thereof in the longitudinal direction being pivotally locked by a central portion of said first support member in the longitudinal direction, one end portion thereof being slidably locked in said first sliding groove, and the other end portion thereof being pivotally locked by one end of said first sliding member;

a third support member having the predetermined length, one end portion thereof being pivotally locked by the other end in the longitudinal direction of the other side surface of said wiper fixer in which said second sliding groove is formed, and the other end portion thereof being slidably locked in said fourth sliding groove; and a fourth support member having the predetermined length, a central portion thereof in the longitudinal direction being pivotally locked by a central portion of said third support member in the longitudinal direction, one end portion thereof being slidably locked in said second sliding groove, and the other end portion thereof being pivotally locked by the other end portion of said second groove member.

4. The line inkjet head cleaning apparatus according to claim 3, further comprising a unit that vertically moves a lifting member that pivotally locks the central portion of said first support member and the central portion of said second support member, and a lifting member that pivotally locks the central portion of said third support member and the central portion of said fourth support member.

5. The line inkjet head cleaning apparatus according to claim 1, further comprising:

a one-end-side groove member fixed to one end portion of each of two side surfaces extending in the longitudinal direction of said wiper fixer, and having a sliding groove obliquely inclining downward;

an other-end-side groove member fixed to the other end portion of each of the two side surfaces extending in the longitudinal direction of said wiper fixer, and having a sliding groove obliquely inclining downward;

movable members formed in one-to-one correspondence with said one-end-side groove member and said other-end-side groove member, each of said movable members having a projection that engages with and slides along said sliding groove; and a moving unit that reciprocates all of said movable members in the longitudinal direction of said wiper fixer such that all the projections of said movable members slide in the same vertical direction in said sliding grooves in synchronism with each other.

6. The line inkjet head cleaning apparatus according to claim 5, wherein said sliding groove formed in said other-end-side groove member obliquely inclines downward to be symmetrical with said one-end-side groove member.

7. A line inkjet head cleaning method for a line inkjet head cleaning apparatus including a wiper fixer extending in a longitudinal direction of a line inkjet head as a cleaning target and having a predetermined width in a vertical direction, a cleaning wiper being fixed to an upper end of the wiper fixer and extending in the longitudinal direction, and a cleaning solution tank having a predetermined volume accommodating the wiper fixer and having an opening in an upper surface, the method comprising the step of:

vertically moving the wiper fixer between a cleaning solution in the cleaning solution tank and the line inkjet head as a cleaning target positioned above the opening to enable the cleaning wiper to contact the line inkjet head without rotating the wiper fixer or the cleaning wiper.

8. A non-transitory computer readable medium storing a line inkjet head cleaning program for a line inkjet head cleaning apparatus including a wiper fixer extending in a longitudinal direction of a line inkjet head as a cleaning target and having a predetermined width in a vertical direction, a cleaning wiper being fixed to an upper end of the wiper fixer and extending in the longitudinal direction, and a cleaning solution tank having a predetermined volume accommodating the wiper fixer and having an opening in an upper surface, the program causing a computer to execute a method, comprising:

vertically moving the wiper fixer between a cleaning solution in the cleaning solution tank and the line inkjet head as a cleaning target positioned above the opening to enable the cleaning wiper to contact the line inkjet head without rotating the wiper fixer or the cleaning wiper.

9. The line inkjet head cleaning apparatus according to claim 3, wherein the driver is disposed outside of the cleaning solution tank.

* * * * *